US006814352B2

(12) United States Patent
Ramseier

(10) Patent No.: US 6,814,352 B2
(45) Date of Patent: Nov. 9, 2004

(54) INSTALLATION FOR THE PROCESSING OF PIECE GOODS

(75) Inventor: Marcel Ramseier, Wetzikon (CH)

(73) Assignee: Ferag AG, Hinwil (CH)

( * ) Notice: Subject to any disclaimer, the term of this patent is extended or adjusted under 35 U.S.C. 154(b) by 120 days.

(21) Appl. No.: 09/834,793

(22) Filed: Apr. 13, 2001

(65) Prior Publication Data

US 2001/0050460 A1 Dec. 13, 2001

(30) Foreign Application Priority Data

Apr. 14, 2000 (CH) ..... 0745/00

(51) Int. Cl.[7] ..... B65H 29/68

(52) U.S. Cl. ..... 271/69; 271/200; 271/205; 271/295

(58) Field of Search ..... 271/69, 200, 204, 271/205, 264, 3.14, 294, 295; 270/52.2

(56) References Cited

U.S. PATENT DOCUMENTS

| | | | | |
|---|---|---|---|---|
| 2,232,720 A | * | 2/1941 | Novick | 271/69 |
| 3,770,144 A | * | 11/1973 | Di Frank et al. | 271/204 |
| 4,201,286 A | | 5/1980 | Meier | |
| 5,007,629 A | | 4/1991 | Eberle et al. | |
| 5,088,711 A | | 2/1992 | Newsome | |
| 5,324,014 A | | 6/1994 | Honegger et al. | |
| 5,503,264 A | | 4/1996 | Eberle | |
| 5,660,382 A | | 8/1997 | Meier | |
| 5,673,869 A | | 10/1997 | Honegger | |
| 5,799,897 A | | 9/1998 | Honegger | |
| 5,913,656 A | | 6/1999 | Collins | |
| 6,237,744 B1 | * | 5/2001 | Reist | 271/204 |

FOREIGN PATENT DOCUMENTS

| | | |
|---|---|---|
| DE | 11 53 383 B | 5/1980 |
| EP | 0 633 212 | 1/1995 |
| WO | 98 03421 A | 1/1998 |
| WO | WO 99/33731 | 7/1999 |

* cited by examiner

*Primary Examiner*—Eileen D. Lillis
*Assistant Examiner*—Michael Lowe
(74) *Attorney, Agent, or Firm*—Pearne & Gordon LLP

(57) ABSTRACT

An installation for processing piece goods including a processing station and a supply unit and/or removal unit. Supply and removal units are displaceable relative to the processing device. Supply and removal units include a closed-in-itself rail track and a plurality of grippers independently traveling along the rail. Supply and removal units further include a take-over drive and a delivery drive, the drives being independent of one another. The delivery drive of the supply unit and the take-over drive of the removal unit include a feature (e.g. a toothed belt) for coupling the drive to the periphery of the processing device. The installation is applicable e.g. for producing products from a plurality of sub-products in a drum-shaped processing device. The installation is very flexible and easy with regard to conversions, adjustments, trouble-shooting and maintenance.

18 Claims, 6 Drawing Sheets

51
10.1
12
21
30
11
16
50
13
30
31
14
32
42
33
1
1.1

INSTALLATION FOR THE PROCESSING OF PIECE GOODS

The invention is in the field of piece goods processing and piece goods conveyance and concerns an installation in accordance with the generic term of the first, independent claim. The installation in essence serves for processing a large number of identical or similar products (piece goods) in series and comprises at least one processing station for processing the products in a substantially serial manner. Products to be processed are supplied to the at least one processing station through at least one supply means and processed products are conveyed away from the at least one processing station through at least one removal means, wherein supply to a first processing station can be combined with removal from a second processing station and can be carried out by a transfer means.

For supply, removal or transfer, the products are conveyed one after the other into the processing station, away from the processing station, or from one processing station to a next processing station. For supply to the processing station, the products are taken over individually from a storage formation or from a preceding conveyor by the supply means and are then conveyed to be individually positioned for processing in a clocked manner. For uncoupling taking-over and positioning, it is advantageous to provide buffering between taking-over and positioning. For removal, products are taken off from the processing station in a clocked manner, are conveyed away and are then deposited in an ordered manner or delivered to a further conveyor. Between taking-off and depositing or delivery the products may also be buffered. For transfer, individual products or small groups of products are taken over in a clocked manner from a first processing station, are conveyed away to be supplied to a second processing station and are positioned in the second processing station individually or in small groups and in a clocked manner, advantageously being buffered between taking-off and positioning.

A means for positioning on the supply side is to operate exactly synchronized with the processing. The same is applicable for means for the taking-off on the removal side. For this reason, at least the positioning and taking-off means are usually rigidly connected with the processing means and in most cases are also driven by the same drive.

An example for an installation of the above mentioned piece goods processing is an installation for producing products from a plurality of sub-products, for example, for producing printed products, such as newspapers, periodicals or brochures, by assembling for every product several sub-products produced in different printing processes and differing from one another at least with respect to content, and if so required joining the sub-products together, for example by stapling or binding. In this case, processing essentially consists of assembling different sub-products and is effected by conveying products being produced from feeding point to feeding point and adding at every feeding point one sub-product to each product being produced, wherein every feeding point is usually supplied with sub-products of one type. The assembled sub-products are then joined to form a product, for example, by stapling or binding, and the products are then conveyed away.

Producing printed products as described above, in essence consists of a plurality of consecutive steps, in each of which a folded sub-product is positioned on a saddle-shaped support or on a folded sub-product already lying on the saddle-shaped support, or a folded sub-product is positioned in a V-shaped compartment or in a folded sub-product already present in the V-shaped compartment or one folded or unfolded sub-product is positioned on a stacking support or on a sub-product already stacked on the stacking support.

Installations for such production of printed products from a plurality of sub-products of different types comprise a means for conveying products being produced e.g. a rotating drum with a multitude of saddle-shaped supports or V-shaped compartments being arranged in a regular manner around the circumference of the drum and extending in axial direction. The products to be produced are positioned on the saddle-shaped supports or in the V-shaped compartments and during rotation of the drum are moved in axial direction from feeding point to feeding point. Instead of the named drums it is also possible to utilize circulation systems, in which saddle-shaped supports, V-shaped compartments or stacking supports are conveyed on an endless track, whereby the products being produced are conveyed over an essentially straight piece of track on the saddle-shaped supports in the V-shaped compartments or on the flat stacking supports. The feeding streams of the sub-products merge into this essentially straight piece of track from above. Thereby, the products being produced may, in addition to being conveyed along this straight track, be displaced perpendicular to the general conveying direction in a similar manner as is the case in the mentioned drums. It is also possible to move the products being produced from feeding point to feeding point along a corresponding support using essentially stationary pushing means.

Installations for producing products from a plurality of sub-products, e.g. printed products from a plurality of printed sub-products, require a number of feeding points, which number varies according to the product to be produced. The outfitting of the feeding points may also vary according to the feeding method and the format of the sub-products to be supplied and the spacing between one feeding point and a next one along the conveying track of the products being produced may vary depending on the format of the sub-products or of the products being produced and/or depending on further processing steps to be carried out between the feeding points. The devices needed for producing one single type of product may all be the same or may be different from one another. In the case of a change from producing one type of product to producing a different type of product, the feeding devices may have to be converted, to be dismantled and replaced, to be newly adjusted and/or to be activated or de-activated, all of this being associated with a substantial working effort and time requirement.

Known installations for producing printed products from a plurality of printed sub-products comprise a conveying means for conveying the products to be produced and at each predefined feeding point, rigidly connected to said conveying means, one feeding device, i.e. at least one sub-product buffer and one means for positioning sub-products in a clocked manner. The simplest of these installations use so-called sheet feeders as feeding devices, in which sheet feeders the sub-products are buffered in a loose stack and are individualized from the stack for being positioned and which sheet feeders are manually supplied with sub-products. Further developed installations (e.g., in accordance with the publications EP-0550828 or U.S. Pat. No. 5,324,014 respectively) comprise more or less automated feeding means in the form of, for example, unwinding stations. These feeding means are also rigidly connected to one specific feeding point, i.e. to the conveying means for conveying the products being produced.

All installations of the above named kind are not well suited for flexible production, i.e. for producing relatively small editions of printed products, wherein the products of subsequent editions differ not only with respect to content and to number of the sub-products, but also with respect to the format of the sub-products and to required handling of the sub-products.

An approach to such flexibilization is to be found in the publication U.S. Pat. No. 5,088,711 (Newsome) describing a displaceable device, which can be connected alternatively to one of a plurality of fixedly installed sheet feeders of different feeding points. The device is manually supplied with sub-products, supply being possible in larger batches than direct supply to the sheet feeder. The sub-products are then loosely stacked on the sheet feeder by the device. The flexibility achieved with this device is limited by the flexibility of the fixedly installed sheet feeders as far as regarding sub-product buffering and positioning and by the flexibility of the operating personnel ar far as regarding sub-product supply. This means, at least regarding sub-product formats and sub-product handling this flexibility is no greater than for installations with directly manually operated sheet feeders. The flexibility achieved with the device according to U.S. Pat. No. 5,088,711 essentially only regards the fact, that the installation can be moved from a currently not active feeding point to an active feeding point.

A further approach to flexibilization of the production of printed products from a plurality of sub-products, in particular flexibilization of the supply side, is described in the publication DE-19634568 or U.S. Pat. No. 5,799,897 respectively. With the device as described in this publication, an attempt is undertaken to solve the flexibility problem by standardization. In a step preceding the actual feeding, standardized feeding formations are established from different storage formations of different types of sub-products. These feeding formations are then supplied without change to buffer devices which are fixedly assigned to one feeding point. From the feeding buffers, the sub-products, once again essentially without any change of the formation, are added to products being produced. Here too, the flexibility is limited to the flexibility of the feeding buffers and of positioning means both being fixedly installed at the feeding points.

The above named wishes regarding flexibility are manifest in particular in connection with supply or feeding means for the named installations for producing products from a plurality of sub-products, which supply means may of course also be transfer means. These wishes are, however, equally valid regarding removal of products in the same sort of installations, i.e. regarding removal means which can also be designed for transfer. And in the same manner the wishes are valid regarding product supply, product removal and product transfer in installations with one or more than one processing station, each of which requires only one supply means.

The invention aims at implementing a further, great step in the direction of increased flexibility for installations for the processing of piece goods and this without any significant additional expense for equipment. The object of the invention consists in creating an installation for processing piece goods, which installation comprises at least one processing station with at least one supply means and at least one removal means, wherein, if required, supply means may be combined with removal means to form transfer means. The inventive installation is to be very easily convertible for consecutive operating phases in which significantly different products are produced.

For piece goods processing which comprises assembling a plurality of sub-products to form a product, using the inventive installation shall make it e.g. possible to produce different product types in consecutive operating phases which product types differ from one another with respect to the number of sub-products, with respect to sub-product formats, with respect to required handling of the sub-products and/or with respect to further processing steps to be carried out between feeding points. The inventive installation shall make it possible to change the type of the sub-product to be fed at a specific feeding point within wider limits than is possible up until now and without any substantial conversion effort, and/or it shall make it possible to make available sections of the conveying track of the products being produced for other processing tasks than adding sub-products and/or it shall make it possible in the case of a reduced operation (producing products from a relatively small number of sub-products) to transfer unused equipment to other installations running in parallel. This objective is achieved by the installation for processing piece goods as defined in the claims.

The invention is based on the idea of implementing a mechanical separation between product processing and product supply or removal in such a manner, that processing functions are clearly separated from supply or removal functions. The mechanical separation is located on the supply side between product processing and positioning of the products for being processed, and on the removal side between product processing and taking-off from processing of processed products, processing itself including only a minimum of conveyance. The supply, removal or transfer functions mechanically separated from the processing function are implemented by mechanical units for product supply, product removal and product transfer, which units are displaceable and advantageously adjustable and which units are couplable to a coupling point of a processing device in such a manner, that through such coupling at least a means for product positioning or for product taking-off being part of the unit is synchronized with the processing device and advantageously is not only synchronized with the processing device, but is also driven by the latter.

The inventive installation for processing piece goods comprises at least one processing device with at least one supply means and at least one removal means, wherein at least one of supply or removal means is designed as a displaceable unit. This unit comprises a drivable means for positioning in the processing device one product per time cycles or a drivable means for taking off from the processing device one product per timing cycle, which drivable means is couplable to the processing device for being synchronized with the processing device or for being driven by and synchronized with the processing device.

In addition to the drivable positioning or taking-off means mentioned above, the units comprise second drivable means i.e. in case of a supply means a means for individualizing or for taking-over, in the case of a removal means a means for depositing or for handing-over and for a transfer means a means for positioning or a means for taking-off. The drives of the two drivable means are independent of one another and advantageously a buffer zone is arranged between the two means.

The units comprise a closed-in-itself rail track system, along which a plurality of product grippers is moved, the grippers having varying distances between one another and being controlled for activation or de-activation.

The couplability to the processing device of the drivable positioning or taking-off means may e.g. be implemented with sensory means, which sensory means senses the processing function of the processing device and generates control signals for controlling a drive for driving the positioning or taking-off means. Advantageously, the coupling means is a power take-off couplable to the periphery of the processing device and taking over from the processing device not only the synchronization, but also the driving power. A power take-off of this type consists, for example, of a toothed belt (synchronous belt) brought into engagement with elements at the periphery of the processing device which elements move with the processing clock.

The inventive installation is described in detail on the basis of exemplary embodiments, wherein.

Figure 1:
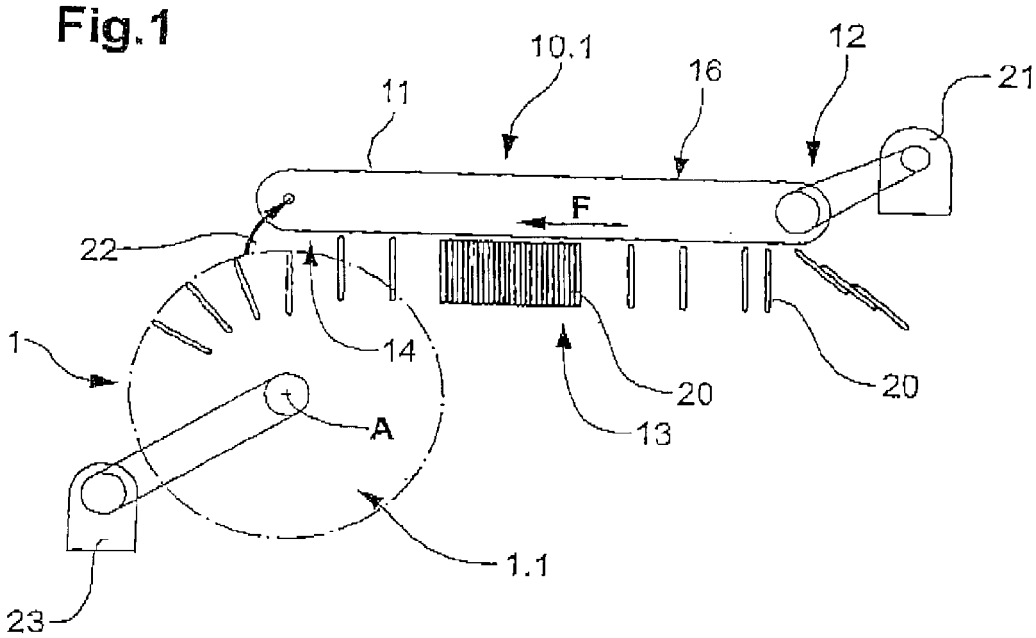
FIGS. 1 to 3 show three exemplary, simple embodiments, of the inventive installation comprising a supply unit (FIG. 1), a removal unit (FIG. 2) or a transfer unit (FIG. 3)
Figure 2:
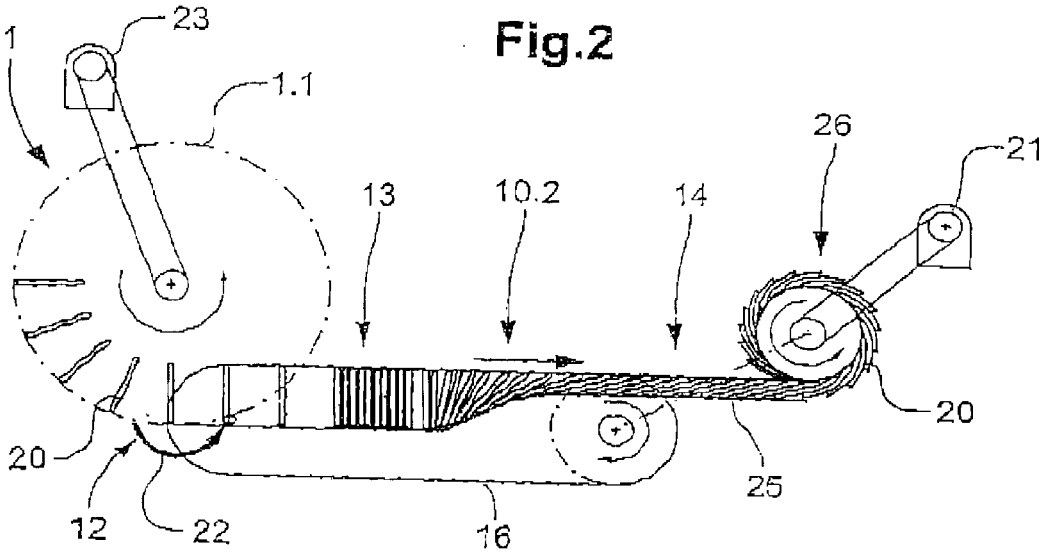
Figure 3:
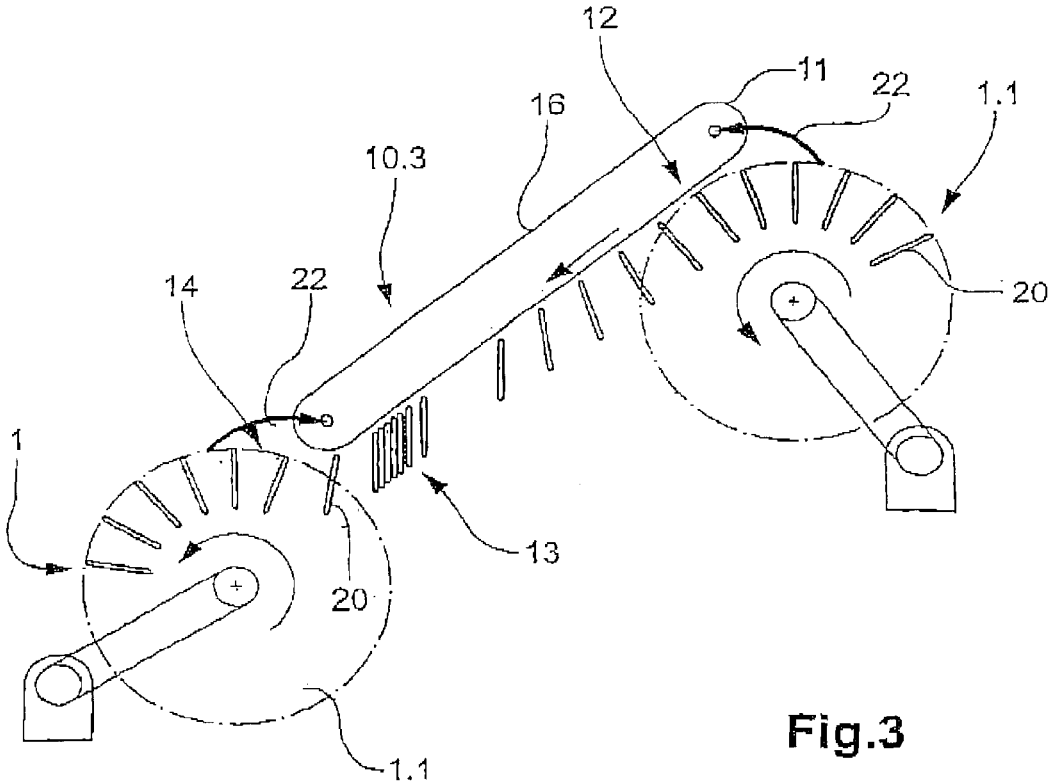
Figure 7:
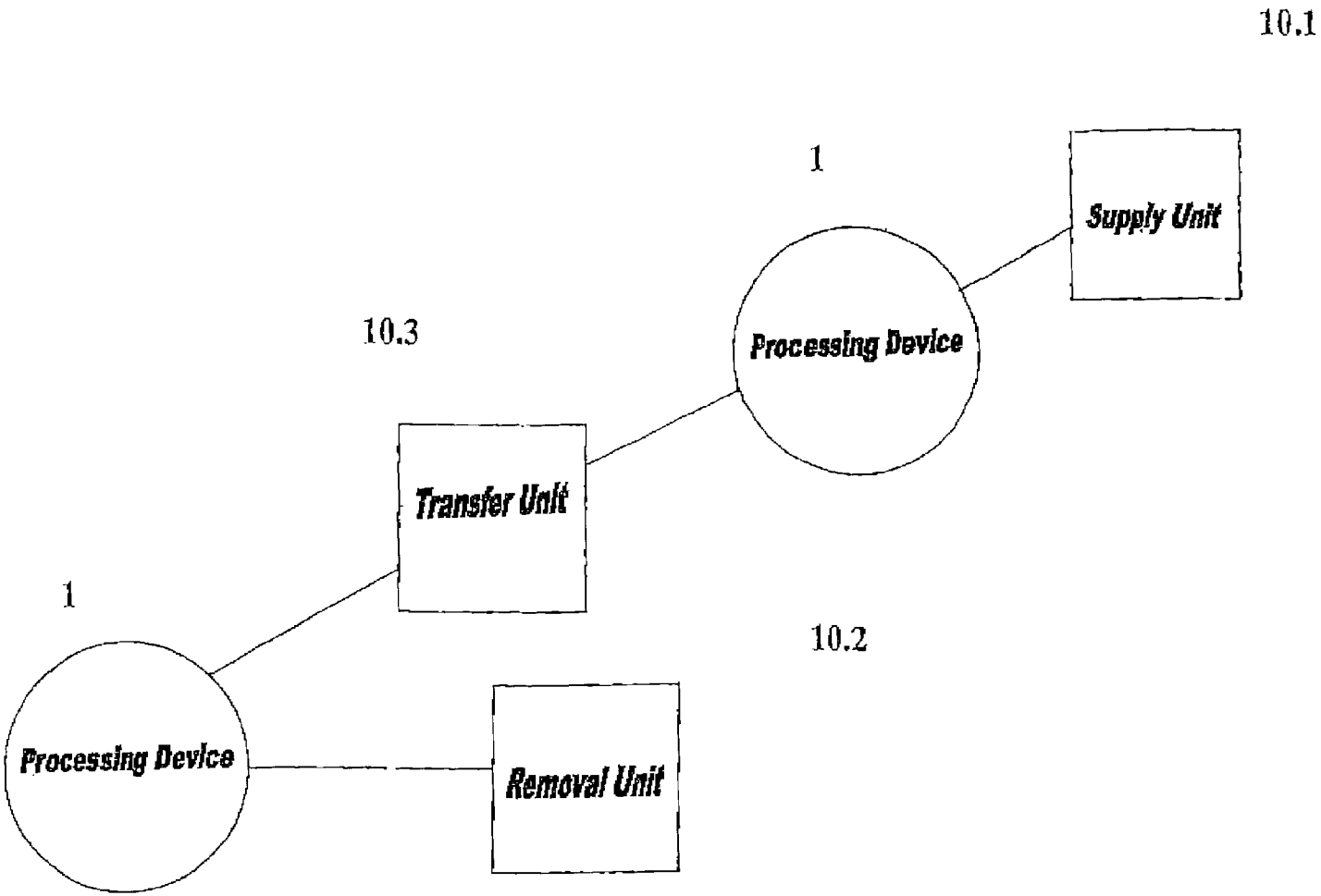
FIG. 7 shows a schematic representation of an installation for processing piece goods.

FIGS. 1 to 3 are very simple schematic illustrations of partial zones of different, exemplary embodiments of the inventive installation for processing piece goods shown in FIG. 7 (large numbers of products 20 or of product groups being handled as units and consisting of a small number of individual products). The exemplary installations depicted in FIGS. 1 to 3 comprise a processing drum 1.1 as an exemplary processing device 1 and coupled thereto a supply unit 10.1 (FIG. 1) or a removal unit 10.2 (FIG. 2). FIG. 3 illustrates a transfer unit 10.3 respectively coupled to a processing unit 1.1 on both sides (combination of removal unit and supply unit).

The feeding, removing, or transfer units 10.1, 10.2 or 10.3 each comprise a closed-in-itself rail track 11, along which a plurality of not depicted product grippers are moved one behind the other. These product grippers are independent of one another or they are connected to one another in such a manner, that the distances between consecutive product grippers are variable. The rail track connects a take-over zone 12, in which the product grippers take over products 20, via a buffer zone 13, in which the product grippers 20 each carrying a product 20 are buffered, with a delivery zone 14, in which the product grippers deliver products 20. From the delivery zone 14 to the take-over zone 12 there is a return track 16 for returning product grippers without products, on which return track 16 the product grippers may also be buffered. It is no condition that all products are delivered in the delivery zone. Therefore, there may be individual product grippers carrying a product on the return track also.

The supply unit in accordance with FIG. 1 comprises in the take-over zone 12 drivable means for the individualization or take-over of the products. This is e.g. (as illustrated) a means for taking-over products 20 from a continuously supplied imbricated product formation. For taking-over, the product grippers are to be clocked in, activated and then moved away. At least a part of these functions is driven through a motor drive 21.

In the delivery zone 14, the products 20 are released by the product grippers and are positioned in the processing device 1. To achieve this, the product grippers are conveyed from the buffer zone 13 to the positioning location, are clocked in, are deactivated and are then conveyed away, wherein clocking-in and de-activation are precisely synchronized with the operation of the processing device 1. For this purpose and advantageously also for driving the positioning means, a coupling (symbolized by the boldface arrow 22) to the processing device 1, resp. to its periphery is provided, for example, a mechanical power take-off.

In a supply unit of an inventive installation it is possible and advantageous to arrange the buffering zone in such a manner, that it comes very close to that point, at which the products are released from the product grippers for being positioned in the processing unit.

The removal unit 10.2 illustrated in FIG. 2 comprises substantially the same functional elements as the supply unit 10.1 of FIG. 1. These are therefore designated with the same reference numbers. In the take-over zone of the removal unit there is a take-off means for removing products from the processing device in a clocked manner, the take-off means being coupled (boldface arrow 22) to the processing device 1. In the delivery zone there is a means for depositing products 20, e.g. in an imbricated formation, onto the feeder belt 25 of a winding station 26. For this purpose, the product grippers are taken from the buffering zone 13, are clocked in, are de-activated and are conveyed away. For these functions the unit comprises a motor drive for the delivery zone or else is coupled to the drive 21 of the winding station.

FIG. 3 depicts a transfer unit 10.3 positioned between two processing drums 1.1 and comprising a take-over zone 12 with a means for taking off products form processing in a clocked manner and a delivery zone 14 with a means for positioning products for processing in a clocked manner, both these means being coupled to the drums 1.1 (boldface arrows 22) for synchronization or for synchronization and power take-off.

The displaceable supply units, removal units and/or transfer units of an inventive installation provide the latter not only, as already described above, with a great flexibility and simplicity regarding conversions, but as a result of the mechanical separation being situated very close to the processing, they prove to be very advantageous and in particular very easily accessible for maintenance, adjustment work and trouble-shooting.

It goes without saying that it is possible, that an inventive installation may comprise a plurality of supply units according to FIG. 1, of removal units according to FIG. 2 and/or of transfer units according to FIG. 3.

Figure 4:
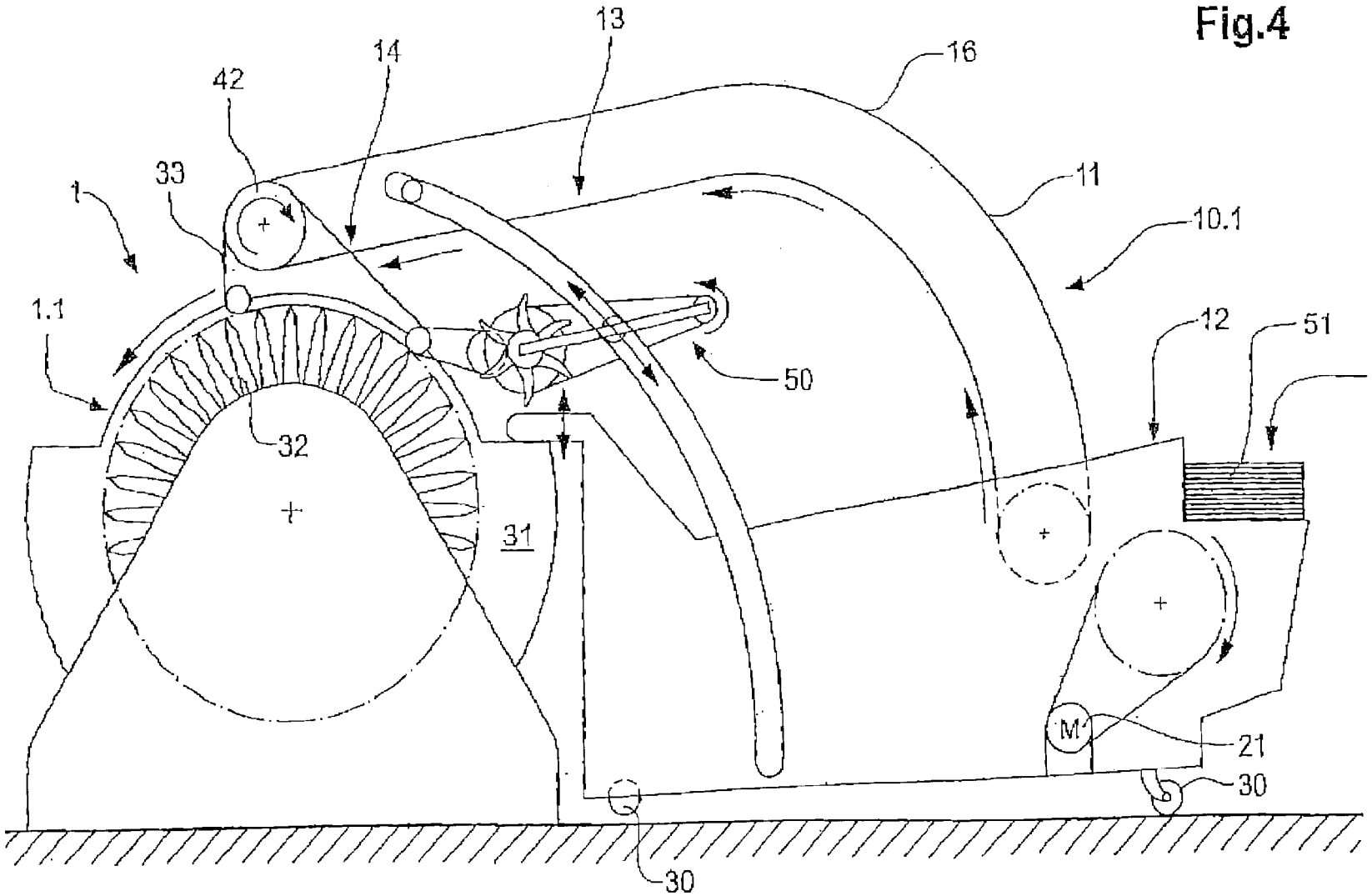
FIG. 4 shows an exemplary supply unit for feeding products supplied in stacks to a processing drum with saddle-shaped supports.
Figure 5:
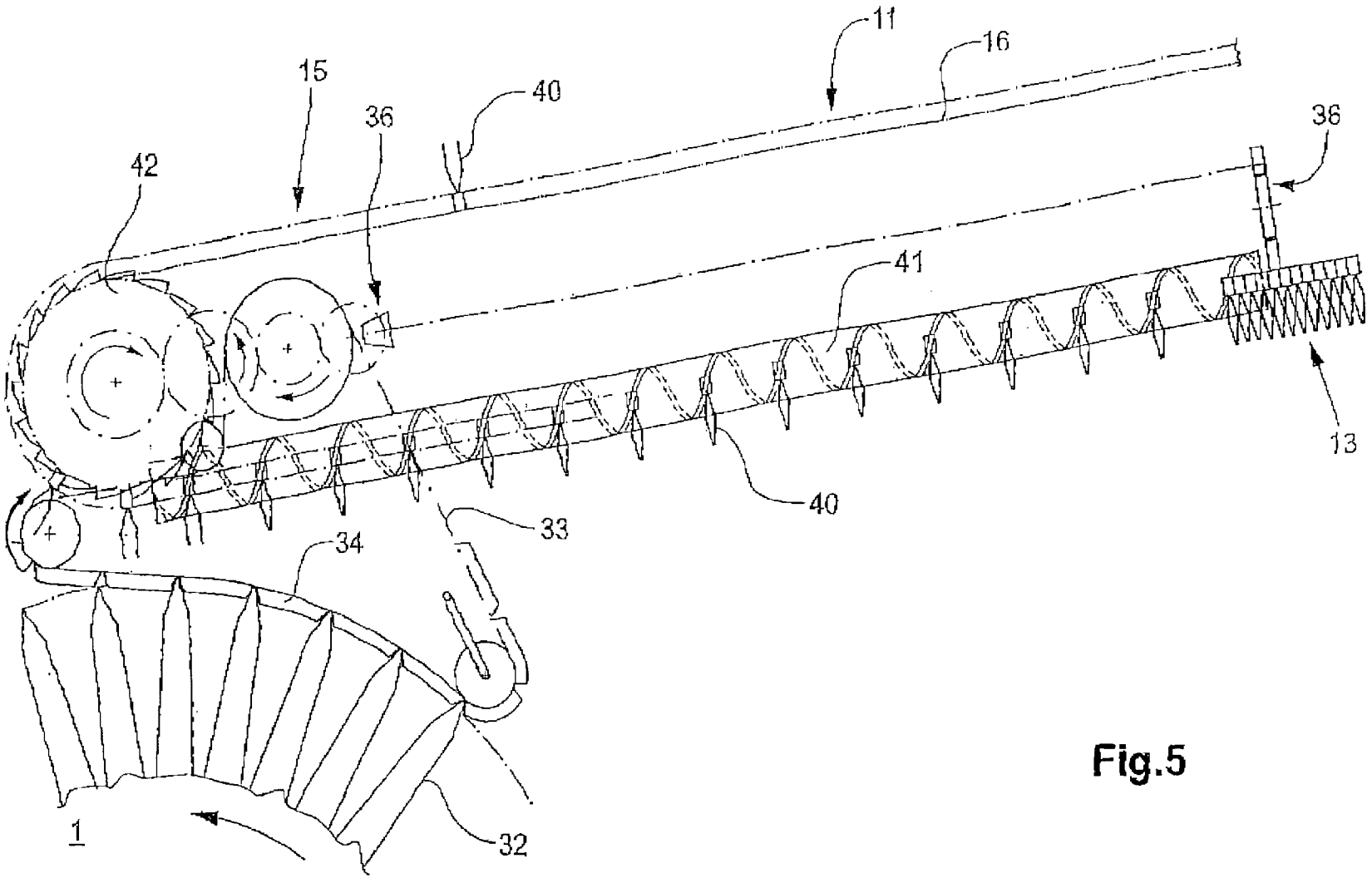
FIG. 5 shows in a larger scale, the means for positioning (part of the supply unit according to FIG. 4) coupled to the processing drum.

FIGS. 4 and 5 depict in more detail a displaceable supply unit 10.1 coupled to a processing drum 1.1 (e.g., a collecting and stapling drum with saddle-shaped supports). FIG. 4 illustrates the complete supply unit 10.1, FIG. 5 its delivery zone 14 in a larger scale. Functional units, which have already been described in connection with FIGS. 1 to 3, are designated with the same reference numbers.

The supply unit is supplied with stacked products in a freely selectable manner, for example, manually. The supply unit can be moved on wheels or on rollers and is supported on the machine frame 31 of the collecting drum 1.1 with an adjustable height. A toothed belt 32 is provided in the delivery zone 14, which toothed belt can be brought into engagement with the saddle-shaped supports of the collecting drum 1.1, the teeth 34 of the belt being matched to the outer edges of the saddle-shaped supports 32. The toothed belt 33 is distanced from the rail track 11 or from the product grippers 40 respectively in the direction of the axis of the drum 1.1. Advantageously, this distance is dimensioned in such a manner, that the toothed belt 33, apart from its function as power take-off can also assume a function as axial stop for a precise alignment of the products to be positioned on the saddle-shaped supports 32.

The toothed belt 33 drives via a suitable set of gears 36 the means for conveying product grippers 40 from the buffering zone 13 towards the positioning point and for clocking them for the positioning. This means for conveying and clocking-in is e.g. a suitable screw conveyor 41 with a pitch increasing towards the point of the actual positioning. In addition, the toothed belt 33 drives a means for conveying away the grippers 40 after the positioning, for example, an engaging drive wheel 42. All other driven means necessary for the positioning are also driven through the toothed belt 33, for example an opening device 50 as schematically illustrated FIG. 4. The opening device 50 serves for opening the products to be positioned, so that they can be placed on the saddle-shaped supports 32 of the drum 1.1.

The buffering zone 13 is advantageously arranged in the area of the rail track 11 sloping downwards in the direction towards the delivery zone 14, such that the product grippers are driven by the force of gravity through the buffer zone and therefore, no mechanical drive is to be provided. Drives to which product grippers are coupled by friction allow buffering zones on rising or level rail tracks also.

In the take-over zone 12 (FIG. 4), a stacking shaft 51 is provided, into which stacked products are positioned and from which these products are individualized in a per se known manner and are taken over by the product grippers 40. A motor drive 21 drives all driven means for individualizing the products from the stacking shaft 51, for conveying the products to the point, at which they are taken over by the product grippers, for clocking-in the grippers and for conveying away the grippers from this point to the buffering zone 13.

The supply unit 10.1 as illustrated in FIGS. 4 and 5 may comprise a continuously moving conveyor element at least in the take-over zone 12 for clocking-in the product grippers 40 for product take-over and for conveying the product grippers 40 away, to which conveyor element the product grippers are couplable, for example, magnetically. A drive of this kind can also extend right into the buffering zone 13, such that the buffering zone may also comprise rising areas of the rail track 11.

A system with a closed-in-itself rail track, with product grippers movable independently of one another along the rail track and with a continuously circulating conveyor element, to which the product grippers are optionally coupled, is described, for example, in the publication WO-99/33731. This system can be used as take-over drive in a supply unit as illustrated in FIGS. 4 and 5.

Figure 6:
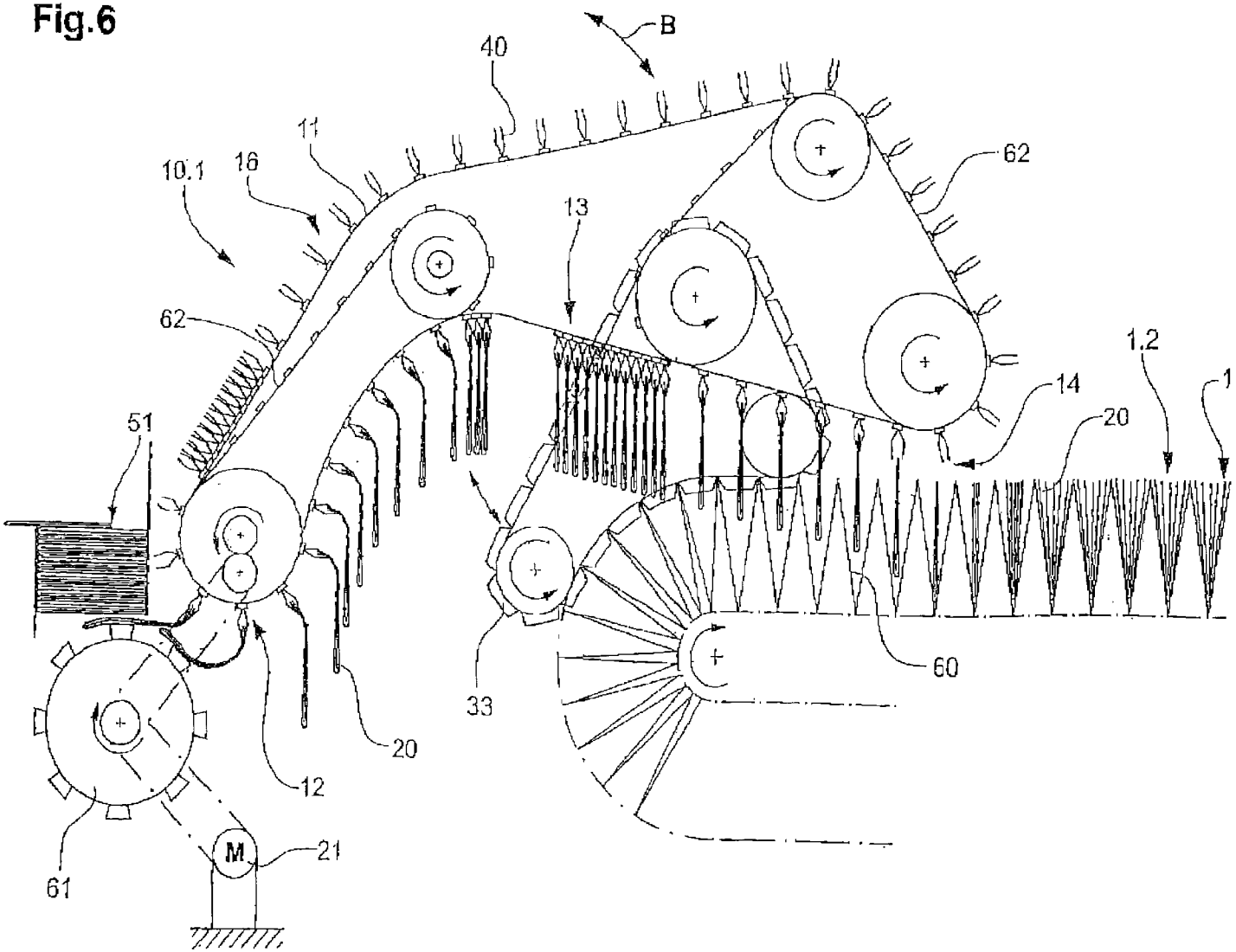
FIG. 6 shows a supply unit for feeding products supplied in stacks to a circulation system with V-shaped compartments.

FIG. 6 depicts a further, exemplary embodiment of the inventive installation for processing piece goods. It shows a supply unit 10.1 being coupled to a processing device 1 having the form of a circulation system with V-shaped compartments 60. Products 20 are placed into the V-shaped compartments, for example, for producing products consisting of several product parts.

The supply unit 10.1 is again designed for handling products 20 supplied in stacks. For individualizing the products from the stacking shaft 51 it comprises a rotating decollating wheel 61 equipped with suction devices. For conveying and clocking-in the product grippers 40, both in the take-over zone 12 as well as in the delivery zone 14 circulating drag chains 62 are provided. In the buffering zone 13 and on the return track 16, the product grippers 40 are driven by the force of gravity. For the activation and de-activation of the product grippers 40 in the take-over zone 12 and in the delivery zone 14, e.g. stationary cams (not illustrated) are provided.

For coupling of the drive of the means for positioning the products in the delivery zone 14 of the supply unit 10.1 there is again a toothed belt 33, which can be brought into engagement with the outside edges of the V-shaped compartments 60 of the circulation system 1.2. Here too, the functional elements of the supply unit 10.1 are mounted on a displaceable stand (not illustrated), which stand allows height adjustment (for example by swivelling at least the delivery zone 14 relative to the circulation system 1.2, in accordance with double arrow B) such allowing handling of different product formats.

A further system being adaptable for feeding, removing or transfer units of an inventive installation is described in the publication EP-0633212. This system comprises a closed-in-itself rail track, product grippers connected by springs and movable at varying distances along the track and two independent drives.

What is claimed is:

1. Installation for processing piece goods, the installation comprising:

at least one processing device (1) with at least one entrance for products (20) to be processed and at least one outlet for processed products (20)

and at least one of a supply unit (10.1) and a removal unit (10.2), wherein the supply unit is arranged at the entrance of the processing device (1) and comprises means for supplying and clocked positioning of products (20) to be processed and, wherein the removal unit (10.2) is arranged at the outlet of the processing device (1) and comprises means for clocked taking off processed products (20) and for conveying away the processed products, wherein said supply and removal units (10.1, 10.2) are displaceable relative to the processing device (1), wherein said supply and removal units (10.1, 10.2) further comprise a closed-in-itself rail track (11) and a plurality of product grippers (40) equipped for traveling along the rail track, for carrying products (20) from a take-over zone (12) through a buffering zone (13) to a delivery zone (14), and for being returned without carrying products from the delivery zone (14) back to the take-over zone (12), wherein said supply and removal units (10.1, 10.2) each further comprise a take-over drive and a delivery drive, the two drives being independent of one another, the delivery drive of the supply unit (10.1) driving at least the means for supplying and clocked positioning, and the take-over drive of the removal unit (10.2) driving at least the means for clocked taking-off and conveying-away, and wherein the delivery drive of the supply unit and the taking-over drive of the removal unit comprise means for being coupled to the periphery of the processing device (1) in order to be synchronized by the processing device.

2. Installation for processing piece goods, the installation comprising:

at least one processing device (1) with at least one entrance for products (20) to be processed and at least one outlet for processed products (20)

and at least one of a supply unit (10.1) and a removal unit (10.2), wherein the supply unit is arranged at the entrance of the processing device (1) and comprises means for supplying and clocked positioning of products (20) to be processed and, wherein the removal unit (10.2) is arranged at the outlet of the processing device (1) and comprises means for clocked taking off processed products (20) and for conveying away the processed products, wherein said supply and removal units (10.1, 10.2) are displaceable relative to the processing device (1)

wherein said supply and removal units (10.1, 10.2) further comprise a closed-in-itself rail track (11) and a plurality of product grippers (40) equipped for traveling along the rail track, for carrying products (20) from a take-over zone (12) through a buffering zone (13) to a delivery zone (14), and for being returned without carrying products from the delivery zone (14) back to the take-over zone (12), wherein said supply and removal units (10.1, 10.2) each further comprise a take-over drive and a delivery drive, the two drives being independent of one another, the delivery drive of the supply unit (10.1) driving at least the means for supplying and clocked positioning, and the take-over drive of the removal unit (10.2) driving at least the means for clocked taking-off and conveying-away, and wherein the delivery drive of the supply unit (10.1) and the take-over drive of the removal unit (10.2) comprise means for being mechanically coupled to the periphery of the processing device (1) in order to be synchronized and powered by the processing device.

3. Installation for processing piece goods, the installation comprising:

at least one processing device (1) with at least one entrance for products (20) to be processed and at least one outlet for processed products (20)

and at least one of a supply unit (10.1) and a removal unit (10.2), wherein the supply unit is arranged at the entrance of the processing device (1) and comprises means for supplying and clocked positioning of products (20) to be processed and, wherein the removal unit (10.2) is arranged at the outlet of the processing device (1) and comprises means for clocked taking off processed products (20) and for conveying away the processed products, wherein said supply and removal units (10.1, 10.2) are displaceable relative to the processing device (1), wherein said supply and removal units (10.1, 10.2) further comprise a closed-in-itself rail track (11) and a plurality of product grippers (40) equipped for traveling along the rail track, for carrying products (20) from a take-over zone (12) through a buffering zone (13) to a delivery zone (14), and for being returned without carrying products from the delivery zone (14) back to the take-over zone (12), wherein said supply and removal units (10.1, 10.2) each further comprise a take-over drive and a delivery drive, the two drives being independent of one another, the delivery drive of the supply unit (10.1) driving at least the means for supplying and clocked positioning, and the take-over drive of the removal unit (10.2) driving at least the means for clocked taking-off and conveying-away, and wherein the delivery drive of the supply unit and the taking-over drive of the removal unit comprise a toothed belt (33) arranged for mechanically coupling the delivery drive and the take-over drive to the periphery of the processing device (1) in order to be synchronized and powered by the processing device.

4. Installation in accordance with claim 3, characterized in that the supply unit (10.1) comprises in its take-over zone (12) a means for taking-over the products (20) from a preceding conveying device or a means for individualizing products (20) from a storage formation, which means is driven by the take-over drive.

5. Installation in accordance with claim 3, characterized in that the removal unit (10.2) comprises in its delivery zone (14) a means for handing-over products to a downstream conveying device or a means for depositing products in an ordered manner, which means is driven by the delivery drive.

6. Installation in accordance with claim 3, characterized in that the supply unit (10.1) comprising a delivery drive couplable to a first processing device is de-signed as a transfer unit (10.3) by further comprising in its take-over zone a take-over drive couplable to a second processing device and driving means for clocked taking-off and for conveying away products from the second processing device.

7. Installation in accordance with claim 3, characterized in that the supply unit (10.1) and the removal unit (10.2) are displaceable on rollers or wheels (30) and are supportable on a machine frame (31) of the processing device (1) with height adjustment.

8. Installation in accordance with claim 3, characterized in that the at least one processing device (1) is a means for producing products from a plurality of sub-products and comprises a plurality of saddle-shaped supports (32), of V-shaped compartments (60) or of stacking supports and that the delivery drive or the take-over drive is couplable to the saddle-shaped supports (32), the V-shaped compartments (60) or to the stacking supports.

9. Installation in accordance with claim 8, characterized in that the processing device (1) is a rotating drum (1.1), in which the saddle-shaped supports (32) or the V-shaped compartments (60) are rotated around a drum axis (A) or is a circulation system (1.2) with a closed-in-itself track for the saddle-shaped supports (32), the V-shaped compartments (60) or for the stacking supports.

10. Installation on accordance with claims 8 or 9, characterized in that a toothed belt (33) capable of being brought into engagement with outside edges of the saddle-shaped supports (32) or of the V-shaped compartments (60) is provided.

11. Installation in accordance with claim 10, characterized in that in the area of the saddle-shaped supports (32) or of the V-shaped compartments (60) alignment means are provided for pushing products after positioning against the toothed belt (33) serving as stop.

12. Installation in accordance with claim 3, characterized in that the supply unit (10.1) comprises as means for supplying and clocked positioning a screw conveyor (41) acting on the product grippers (40) and an engaging drive wheel (42) being arranged in the delivery zone (14).

13. Installation in accordance with claim 3, characterized in that the supply unit (10.1) comprises as means for supplying and clocked positioning a driving belt (62) acting on the product grippers (40) and being arranged in the depositing zone (14).

14. Installation in accordance with claim 3, characterized in that the supply unit (10.1) comprises an opening device (50) driven by the delivery drive and being arranged in the delivery zone (14).

15. Installation in accordance with claim 3, characterized in that the supply unit (10.1) comprises in the take-over zone (12) as a part of the take-over drive a driving belt (62) acting on the product grippers (40).

16. Installation in accordance with claim 3, characterized in that the supply unit (10.1) comprises in the take-over zone (12) a stacking shaft (51) and a means (61) for individualizing products (20) being loosely stacked in the stacking shaft (51).

17. Installation in accordance with claim 3, characterized in that the supply unit (10.1) comprises in the buffering zone (13) a rail track (11) part inclined down-wards towards the delivery zone (14), or that the removal unit (10.2) comprises a rail track part inclined downwards towards the take-over zone (12).

18. Installation in accordance with claim 3, characterized in that the supply unit (10.1) comprises in the take-over zone (12) a circulating conveyor element, to which the product grippers (40) are optionally coupled and that the conveyor element extends at least into the buffering zone (13).

* * * * *

UNITED STATES PATENT AND TRADEMARK OFFICE

CERTIFICATE OF CORRECTION

PATENT NO. : 6,814,352 B2
DATED : November 9, 2004
INVENTOR(S) : Marcel Ramseier It is certified that error appears in the above-identified patent and that said Letters Patent is hereby corrected as shown below:

Column 6,
Line 58, please delete "32", and insert therefor -- 33 --.

Column 8,
Line 67, after "processing device (1)", please insert -- , --.

Signed and Sealed this

Twenty-eighth Day of June, 2005

JON W. DUDAS
*Director of the United States Patent and Trademark Office*